US007387460B2

(12) United States Patent
Coffelt et al.

(10) Patent No.: US 7,387,460 B2
(45) Date of Patent: Jun. 17, 2008

(54) COLLATING STACKER AND METHOD OF USE

(75) Inventors: David J. Coffelt, Owego, NY (US); Barton Varney, Binghamton, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 310 days.

(21) Appl. No.: 11/028,651

(22) Filed: Jan. 5, 2005

(65) Prior Publication Data

US 2006/0163791 A1 Jul. 27, 2006

(51) Int. Cl.
*B41J 13/00* (2006.01)

(52) U.S. Cl. ..... 400/647.1; 270/1.02

(58) Field of Classification Search ..... 400/642, 400/645, 645.4, 647.1; 271/1, 2, 30.05
See application file for complete search history.

(56) References Cited

U.S. PATENT DOCUMENTS 3,608,743 A * 9/1971 Mosher et al. ..... 414/5
4,293,214 A * 10/1981 George et al. ..... 399/403
4,358,197 A * 11/1982 Kukucka et al. ..... 399/19
4,749,179 A 6/1988 Hornung
4,871,158 A * 10/1989 May et al. ..... 270/58.11
5,207,412 A * 5/1993 Coons et al. ..... 270/1.02
5,215,428 A 6/1993 Masini
5,346,206 A * 9/1994 Steinhart ..... 271/305
5,375,967 A 12/1994 Rathert
5,669,755 A 9/1997 Zahn
5,733,099 A 3/1998 Honneger
5,970,834 A 10/1999 Garofano et al.
6,209,938 B1 4/2001 James, Jr.
6,241,233 B1 6/2001 DeVlaam
6,322,117 B1 11/2001 James, Jr.
6,402,455 B1 6/2002 Vincent et al.
6,416,099 B1 7/2002 James, Jr.
6,481,952 B2 11/2002 Deutschle et al.
6,543,983 B1 * 4/2003 Felder et al. ..... 414/402
6,615,565 B2 9/2003 Dekker
6,736,388 B2 * 5/2004 Lawrence ..... 270/58.08

* cited by examiner

*Primary Examiner*—Anthony H. Nguyen
(74) *Attorney, Agent, or Firm*—Greenblum & Bernstein P.L.C.

(57) ABSTRACT

A system and method designed to collate sequenced product. The system includes a holding bin having a first open end and a second open end. A moveable table is positioned at the first open end of the holding bin. A sheet inserter mechanism is positioned adjacent to the second open end of the holding bin, and includes an inserting mechanism which inducts a sheet of material into the holding bin between product for each discrete delivery destination. In this manner, a collated stack of sequenced product may be formed by the system.

19 Claims, 3 Drawing Sheets

COLLATING STACKER AND METHOD OF USE

FIELD OF THE INVENTION

The invention generally relates to a collating stacker system and, more particularly, to a collating product stacker and a method of segregating and stacking product such as mail pieces.

BACKGROUND DESCRIPTION

The sorting of mail is a very complex, time consuming task. In general, the sorting of mail is processed through many stages, including back end processes, which sort or sequence the mail in delivery order sequence. These processes can either be manual or automated, depending on the mail sorting facility, the type of mail to be sorted such as packages, flats, letters and the like. A host of other factors may also contribute to the automation of the mail sorting, from budgetary concerns to modernization initiatives to access to appropriate technologies to a host of other factors.

In general, however, most modern facilities have taken major steps toward automation by the implementation of a number of technologies. These technologies include, amongst others, letter sorters, parcel sorters, advanced tray conveyors, flat sorters and the like. As a result of these developments, postal facilities have become quite automated over the years, considerably reducing overhead costs and increasing mail throughput.

By way of example, in front end processes, sorting and sequencing systems are capable of sequencing mail pieces and other product based on a two pass algorithm system. Of course, other known systems can equally be used to sort mail pieces and other product, a host of them readily available and known to those of ordinary skill in the art. In one such known system, sorting devices include one or more feeders with feed rate capacities ranging from approximately 40,000 letters per hour and approximately 10,000 flats per hour.

As the mail pieces are inducted into the system, they may be fed onto conveying tracks such as belt transports, pocket/cartridge transports or any other well known conveying or transporting system. The mail process or other items then pass a camera, optical reading device, bar code scanner or other type of reading device used to read destination information from the mail pieces. This information is then provided to a control, which uses such information to coordinate the movements of the mail pieces to predetermined bin locations, via diverters or other known systems. In a two pass system, the mail pieces are now in a sort order.

However, to place the mail pieces in a walk order sequence, for example, the mail pieces are again inducted into the system for a second pass. During this second pass, the destination information is again read and provided to the control. With this information, the control can then coordinate the movements of the mail pieces to respective bin locations. It is during this second pass, that the mail pieces are then provided in a sequenced stream, e.g., walk order sequence.

During this sequencing, the mail pieces or other product are initially unloaded to containers located at each drop off point, via chutes. In this manner, the mail pieces are slid down the chutes into the containers and are stacked within the containers in a sequenced order. Although the mail pieces are provided within the containers in a delivery order sequence, there is typically no indicia or other means to determine the exact address of such mail pieces. This may result in lost efficiency, i.e., incorrect delivery of the mail pieces or loss of sequence integrity. This is basically due to the fact that the mail carrier, for example, has to sift through the containers for each mail delivery address, missing some addresses or, when returning the mail pieces into the container, misplacing them out of sequence. In the latter situation, there is the possibility that the mail carrier may incorrect replace the mail piece into the container out of sequence. So, in the containers, the mail pieces can shift out of sequence with respect to one another, especially during the delivery of the mail pieces by the mail carrier.

If the mail pieces lose their sequence integrity, it becomes much more time consuming for the mail carrier to properly delivery the mail pieces. And, in instances, the mail pieces may have to again be sequenced, but during the delivery process. This adds to the delivery time and, ultimately, the cost of delivery of the mail pieces. It also may lead to the improper delivery of the mail pieces or mail pieces being undeliverable.

To complicate these problems, in some systems, flats and other types of mail pieces are sequenced separately due to the limitations of the sorting systems. In these situations, the sequenced mail pieces and flats are provided in different containers. For this reason, it becomes very difficult and time consuming for a mail carrier to separate and efficiently delivery the combined mail, when the mail pieces and flats are provided in separate containers, possibly out of sequence for the reasons enumerated above.

The invention is directed to overcoming one or more of the problems as set forth above.

SUMMARY OF THE INVENTION

In a first aspect of the invention, a system is designed to collate sequenced product. The system includes a holding bin having a first open end and a second open end. A moveable table is positioned at the first open end of the holding bin. A sheet inserter mechanism is positioned adjacent to the second open end of the holding bin, and includes an inserting mechanism which inducts a sheet of material into the holding bin between product to form a collated stack of product. In embodiments, a printer may print indicia on the sheet, associated with each product.

In a second aspect of the invention, the system includes a holding bin designed to stack product therein and a moveable table moveable between a first position proximate to the holding bin, a second position remote from the holding bin and a rotated position. A sheet inserter mechanism is proximately positioned adjacent to the second open end of the holding bin and includes an inserting mechanism and a printing mechanism. The inserting mechanism inducts a sheet of material into the holding bin between product for each discrete delivery destination to form a collated stack of sequenced product. The printing mechanism prints indicia on the sheet of material associated with the each discrete delivery destination. A controller coordinates, for example, the induction of the product and sheet of material into the holding bin such that the sheet of material will be inducted between the product for each discrete delivery destination to form the collated stack of sequenced product.

In another aspect of the invention, a method includes coordinating a placement of sheets between product for each discrete delivery destination of the product to form a collated stack of sequenced product, and moving the collated stack of sequenced product from a first position to a rotated, second position. The collated stack of sequenced product is then placed into a container, in substantially a same orientation as the rotated, second position.

BRIEF DESCRIPTION OF THE DRAWINGS

The foregoing and other objects, aspects and advantages will be better understood from the following detailed description of embodiments of the invention with reference to the drawings, in which.

DETAILED DESCRIPTION OF EMBODIMENTS OF THE INVENTION

The invention is directed to a collated mail stacker designed to stack product such as mail pieces, flats and other mail items (product) into a container. The system of the invention is a back end processing system and method of use, utilized preferably after sorting and/or sequencing of the product. The system and method of the invention significantly reduces processing times for collating or segmenting all types of product, including both flats and mail pieces or other disparate products in delivery point sequence. Other applications such as warehousing and storage applications are also contemplated for use with the invention.

System of the Invention

Figure 1:
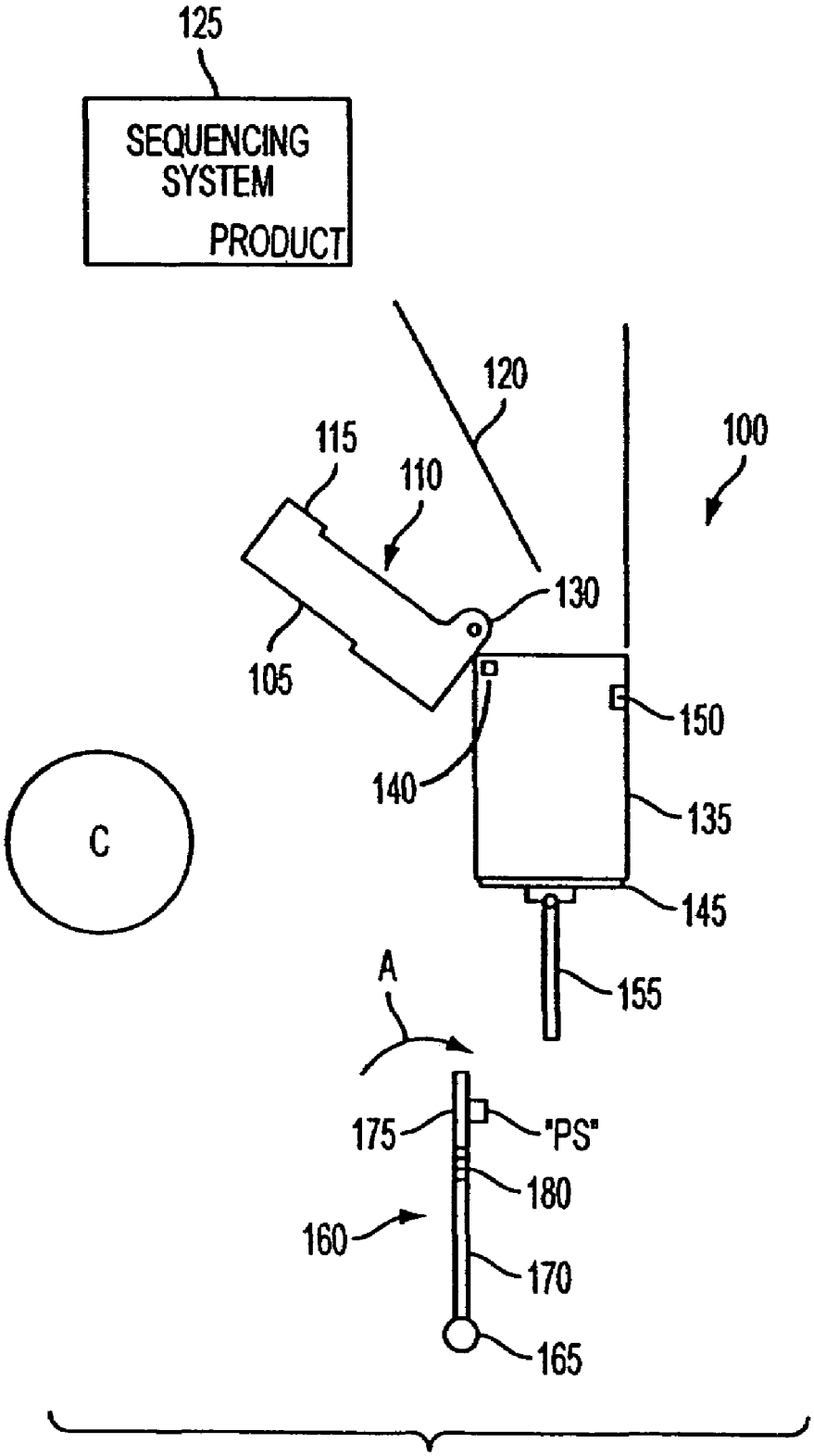
FIG. 1 shows a schematic diagram of the system of the invention.

Referring now to FIG. 1, a schematic diagram of the collated mail stacker system (hereinafter referred to as the system) is shown. In the embodiment of FIG. 1, the system is generally depicted as reference numeral 100 and includes a sheet feeding or inserter mechanism 105. The sheet feeding mechanism 105 includes a holding portion 110 which is designed to hold separate or separable (e.g., perforated) sheets of paper or other material. A printer 115 is positioned proximate to the sheet feeding mechanism 105, and is designed to print address or other pertinent information on the sheet of material. This other information may include time stamped information, ordering information, etc. The address or other pertinent information will be associated with a single or several product for a single delivery address, group of product, ordering information or any other type of required ordering.

In an alternative embodiment, the sheet may be a different color for adjacent groups of product to be collated, or may be alternating colors to distinguish each group. As discussed above, the group of product, which may be mail pieces, may include discrete delivery destinations, ordering information, etc. The sheet is receivable and inducted from a product slide or related induction mechanism 120. The product slide 120 receives sequenced product from any known sequencing system, designated generally as 125, as well as inducts such product into a bin 135.

The sheet feeding mechanism 105 additionally includes a roller or other feeding device designated as reference numeral 130. The feeding device 130 feeds the sheets of material to the bin 135. In one implementation, the size or length of the material will be slightly larger than the width of the bin 135 (and height of a container) so that a tab is formed when product is placed therein (as discussed below). The tab should preferably include the printed information. In the case of perforated or a single sheet, the roller or other feeding device may include a cutting device 140.

A moveable table 145 is positionable at the remote portion of the bin 135, with respect to the product slide. In one implementation, the moveable table 145 is positioned at the bottom of the bin 135. The product will be placed into the bin 135, stacked on the table 145 in a sequenced order. The product will be provided by the sequencing system 125 and more particularly will be placed into the bin 135 from the product slide 120. In one embodiment, the printing, induction of the paper into the bin 130 and the induction of the product into the bin 130 is coordinated by a controller "C". In this manner,

- The printer can print address or other pertinent information associated with product to be placed within the bin;
- The sheet of material with the printed matter can be inducted into the bin; and
- The product can be inducted into the bin, in sequence, in a collated manner with respect to the sheet of material.

In one aspect of the invention, a sensor such as a photodiode 150 is provided proximate to or on the bin 135. The sensor may alternatively be a weight sensor, encoder or other measuring device to determine the height or maximum allowable weight of the product within the bin 135. In one implementation, the sensor may provide information to the controller "C" in order to coordinate movement of the moveable table 145 when the bin is full. For example, in the application of a photodiode, when the product interferes with a light path of the photodiode, the controller "C" may then determine that the bin is full and direct movement of the moveable table 145.

The moveable table 145 includes a lifting mechanism 155 such as, for example, a hydraulic lift, linear motor or rack and pinion gear. The lifting mechanism 155 is designed to lower the moveable plate proximate to a clamping arm 160. The lifting mechanism 155 is also designed to lift the lifting mechanism 155 to the bin 135, as shown in FIG. 1.

Still referring to FIG. 1, the clamping arm 160 includes a pivoting mechanism 165 attached to a first arm segment 170. A clamp arm 175 is rotatably mounted to the first arm segment, and may be rotated by a ratchet assembly, hydraulic system, gear drive, air motor, to name a few, generally shown as reference numeral 180. The clamp arm 175 may be rotated in direction of arrow "A", initially. The clamp arm 170 may also include a pressure sensor "PS".

In one aspect of the invention, the clamping arm 160 and the moveable table 145 are designed to rotate approximately 90 degrees from the vertical, while holding product therebetween. For example, after the moveable table 145 is lowered with the collated stack of product, the clamp arm 175 may be rotated in the direction of arrow "A". The clamp arm 175 will provide sufficient force against the collated stack of product to ensure that the collated stack of product will remain secured between the clamp arm 175 and the moveable table 145 during the rotation process.

In one example, the pressure sensor "PS" may provide pressure information to the controller "C". This information can then be used by the controller "C" to determine whether additional force is required in order to secure the stack of product on the moveable table 145 during the rotation process. If there is not enough force, the controller "C" may instruct the clamp arm 175 to provide additional force to the collated stack of product and, thereafter, instruct the clamping arm 160 and the moveable table 145 to rotate approximate 90 degrees. Once the clamping arm 160 and the moveable table 145 are rotated, the controller may then be used to instruct the clamp arm 175 to release the product into a container. Alternatively, an encoder or counter may be used to determine a position of the clamping arm 160 and the moveable table 145, and then at such appropriate stage, the clamp arm 175 will release pressure from the product.

Method of Using the System of the Invention

Figure 2A:
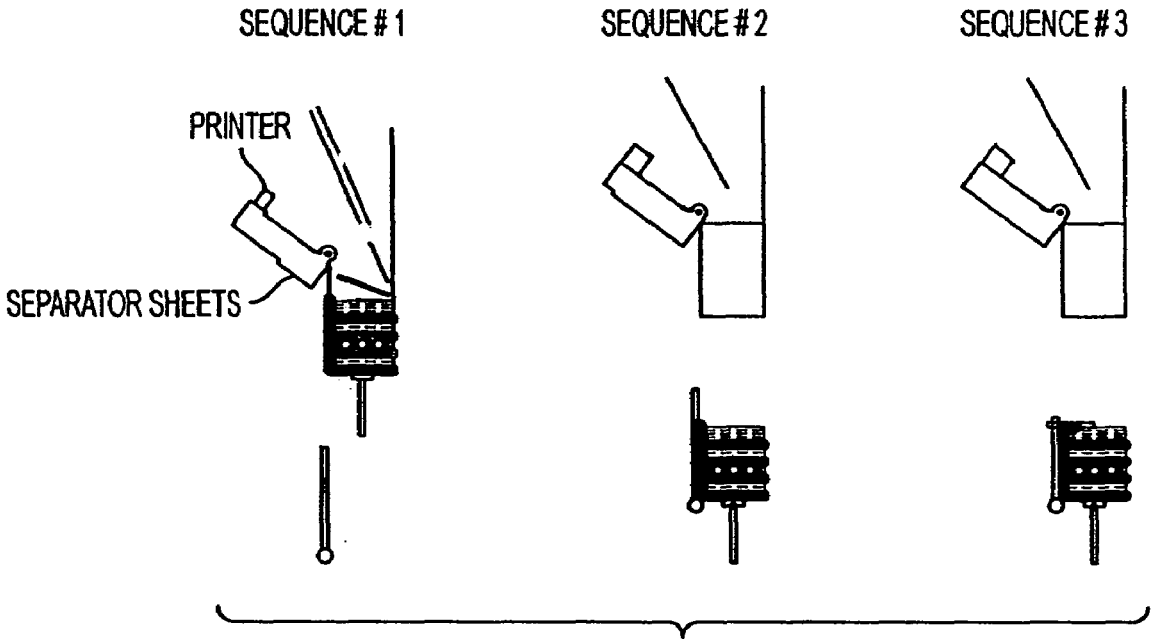
FIGS. 2*a*-2*b* show processing sequences in accordance with the invention.
Figure 2B:
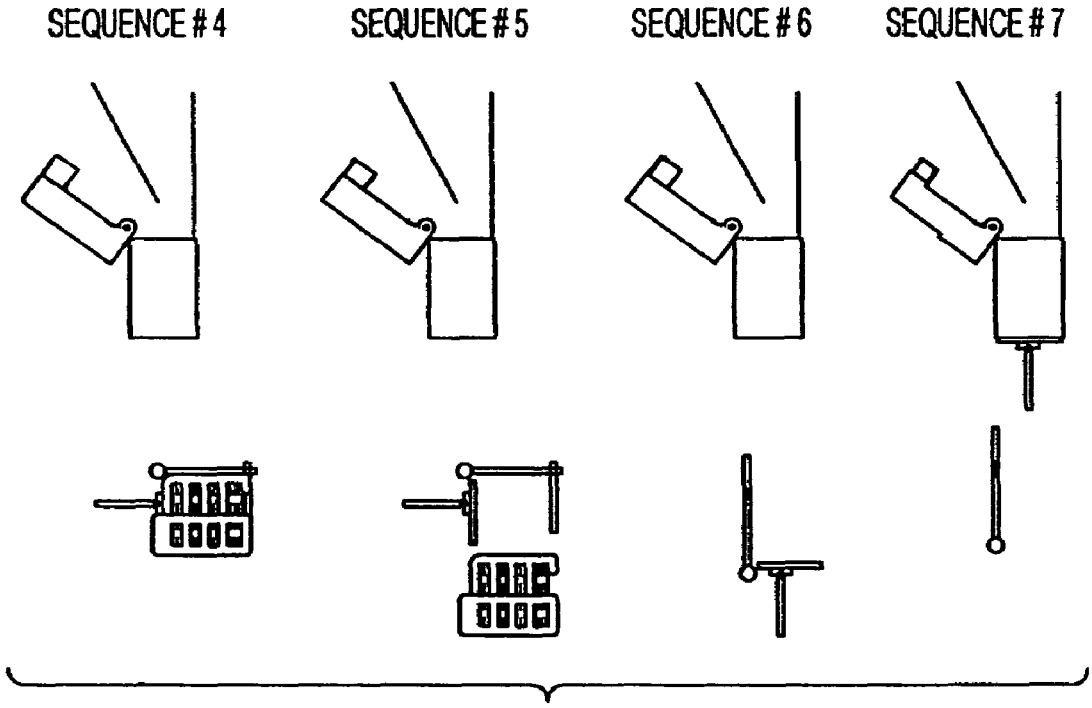

FIGS. 2*a* and 2*b* show operational stages 1-7 using the system of the invention. FIGS. 2*a* and 2*b* may equally represent a flow showing the steps of implementing the method of the invention. The steps of the invention may be implemented on computer program code in combination with the appropriate hardware. This computer program code may be stored on storage media such as a diskette, hard disk, CD-ROM, DVD-ROM or tape, as well as a memory storage device or collection of memory storage devices such as read-only memory (ROM) or random access memory (RAM).

The system of the invention may be used for a single carrier route at a time, multiple routes at once or for warehousing or other sequencing needs of pre-sequenced products. Also, some or all of the different operational stages shown in FIGS. 2*a* and 2*b* may be coordinated by the controller "C", and performed synchronously or asynchronously with two or more of the systems described herein.

In operational stage 1, the controller coordinates the printing of indicia on the sheet of material, as well as the induction of the product and sheet(s) or material into the bin. By way of example, the printer will print an address or other pertinent information on the sheet of material and the sheet feeding mechanism will then induct the printed sheet into the bin.

The product associated with the printed indicia will then be inducted into the bin, as coordinated by the controller "C". This is accomplished by maintaining track of the product as it is sorted and prior to induction into the system (with or without control). In this manner, a sheet of material will be provided at the bottom of the stack and between the product for each delivery destination.

It should be recognized that the induction of the printed sheet of material and the product may be inducted into the system in the reverse order. For example, the product may first be inducted into the bin and, thereafter, the printed sheet of material may be inducted into the bin, above the associated product. In this manner, the sheets will be provided between the product, for each delivery destination, and at a top of the stack of the collated sequence of product. The operational stage 1 will continue, for example, until the bin is filled or other criteria is satisfied such as, for example, no more product remains for a particular carrier route.

In operational stage 2, the moveable table is lowered and, in operational stage 3, the clamp arm will rotate in order to secure the collated stack of product to the moveable table. In operational stage 4, the moveable table and the clamping arm are rotated and, in operational stage 5, the product is released into a container. This latter operational stage may be accomplished by removing force on the collated stack of product, via the clamp arm. This may be accomplished via the controller "C" or an encoder, which is based on the time to rotate the table and the clamping arm above the container.

In operational stage 6, the table and the clamping arm are rotated into the vertical position. In operational stage 7, the table is lifted or moved into proximity of the bin so that the process can continue at operational stage 1, if required.

EXAMPLE OF USE

By way of illustrative example, at the sorting/sequencing system, product may be sequenced and provided to the product slide 120. During or prior to this operational stage, the product information may be provided to the controller "C" (associated with each address or other pertinent location), which will then direct the printer to print appropriate information on the sheet. The sheet will then be discharged into the bin, with the printed information being provided on a "tab". In one embodiment, printed indicia may not be required by the system, and the use of the tab would suffice to provide collation between separated product within the stack.

The product associated with the sheet will then be placed in the bin, e.g., on the table. This process will continue until the bin is full or other predetermined criteria is met such as, for example, no further product remains for a carrier route. In this manner, the controller "C" may coordinate the print of the information, feeding of the paper and the product into the bin.

Once the bin is full, the table will be lowered and the clamp arm will then clamp or secure the collated stack of product in place on the table. The product is then rotated and released into a container. The sheets of material will provide a separation of product for each delivery point, with the tab extending from the container to designate the delivery point. In this manner, a defacto package may be provided.

While the invention has been described in terms of embodiments, those skilled in the art will recognize that the invention can be practiced with modification within the spirit and scope of the appended claims.

It is claimed:

1. A system for collating sequenced product, comprising:

a holding bin having a first open end and a second open end, the holding bin designed to stack product therein;

a moveable table positioned at the first open end of the holding bin, the moveable table being moveable between positions; and a sheet inserter mechanism proximately positioned adjacent to the second open end of the holding bin, the sheet inserter mechanism including an inserting mechanism which inducts a sheet of material into the holding bin between product to form a collated stack of sequenced product.

2. The system of claim 1, further comprising a printing mechanism which prints indicia on the sheet of material associated with each separate group of product in the collated stack of sequenced product.

3. The system of claim 1, further comprising a lifting mechanism coupled to the moveable table and which moves the moveable table between a first position proximate to the holding bin and a second position, remote from the holding bin.

4. The system of claim 3, further comprising an induction mechanism which inducts the product, in a sequence, into the holding bin to form the collated stack of sequenced product.

5. The system of claim 3, further comprising a clamping arm including a rotatable clamp arm, the clamping arm positioned at approximately the second position.

6. The system of claim 5, wherein the clamp arm secures the collated stack of sequenced product to the moveable table when the moveable table is in the second position.

7. The system of claim 5, wherein the clamping arm and the moveable table are rotatable approximately 90 degrees from a vertical position.

8. The system of claim 5, further comprising a pressure sensor associated with the clamp arm to determine a force applied to the collated stack of sequenced product when the moveable table is rotated.

9. The system of claim 1, further comprising a controller which coordinates the induction of the product and the sheet of material into the holding bin such that the sheet of material will be inducted into the holding bin between the product for each group of the collated stack of sequenced product and (i) prior to the induction of a first product or (ii) after the induction of a last product to form the collated stack of sequenced product.

10. The system of claim 9, wherein the controller further coordinates printing on the sheet of material prior to the induction thereof, the printing designating a delivery destination for each of the product forming the collated stack of sequenced product.

11. The system of claim 1, further comprising a controller which coordinates the movement of the moveable table between the positions.

12. The system of claim 1, further comprising:

a printing mechanism which prints indicia on the sheet of the material associated with each discrete delivery destination of the collated stack of sequenced product; and a controller which coordinates:

the induction of the product into the holding bin;

the induction of sheet of material into the holding bin such that the sheet of material will be inducted at least between the product for each discrete delivery destination to form the collated stack of sequenced product, and the movement of the moveable table to a remote location from the holding bin.

13. The system of claim 1, further comprising a sensor for measuring an amount of product within the holding bin.

14. The system of claim 1, wherein the collated stack of sequenced product are mail pieces.

15. The system of claim 14, wherein the inserting mechanism inducts a sheet of material into the holding bin between product defined as mail pieces for each discrete delivery destination to form the collated stack of sequenced product.

16. The system of claim 1, wherein one of:

the sheet of material is a different color for at least adjacent groups forming the collated stack of sequenced product; and the sheet of material includes indicia which indicates a separation of different groups forming the collated stack of sequenced product.

17. A system for collating mail pieces, comprising:

a holding bin having a first open end and a second open end, the holding bin designed to stack mail pieces therein;

a moveable table moveable between a first position proximate to the holding bin, a second position remote from the holding bin and a rotated position;

a sheet inserter mechanism proximately positioned adjacent to the second open end of the holding bin, the inserting mechanism including:

an inducting mechanism which inducts sheets of material into the holding bin each of which are inducted, separately, between mail pieces for each discrete delivery destination to form a collated stack of sequenced mail pieces, and a printing mechanism which prints indicia on the sheet of material associated with the each discrete delivery destination; and a controller which coordinates:

the induction of the mail pieces into the holding bin, and the induction of the sheets of material into the holding bin such that the each of the sheets of material will be inducted between the mail pieces for each discrete delivery destination to form the collated stack of sequenced mail pieces.

18. The system of claim 17, further comprising:

a sorting system for sequencing the mail pieces; and an induction mechanism which inducts the mail pieces in a sequence from the sorting system into the holding bin to form the collated stack of sequenced mail pieces.

19. The system of claim 17, further comprising a sensor for measuring an amount of mail pieces within the holding bin.

* * * * *